US005439188A

United States Patent [19]

Depew, Jr. et al.

[11] Patent Number: 5,439,188

[45] Date of Patent: Aug. 8, 1995

[54] CONTROL SYSTEM

[75] Inventors: Herbert D. Depew, Jr.; Robert J. Ernst, Jr., both of Los Altos, Calif.

[73] Assignee: Hughes Missile Systems Company, Los Angeles, Calif.

[21] Appl. No.: 395,112

[22] Filed: Sep. 4, 1964

[51] Int. Cl.[6] ..... F42B 10/14; F42B 15/01

[52] U.S. Cl. ..... 244/3.21; 244/3.27

[58] Field of Search ..... 244/14, 14 A, 14 D, 244/14 E, 14 H, 14 J, 3.16, 3.21, 3.23, 3.24, 3.27, 3.28, 3.3; 102/50 FF

[56] References Cited

U.S. PATENT DOCUMENTS

| | | | |
|---|---|---|---|
| 2,165,800 | 7/1939 | Koch | 102/3 |
| 2,346,977 | 4/1944 | La Sha | 244/129 |
| 2,797,666 | 7/1957 | Chubbuck | 121/41 |
| 2,873,074 | 2/1959 | Harris, Jr. et al. | 244/14 |
| 2,925,966 | 2/1960 | Kongelbeck | 244/14 |
| 3,010,677 | 11/1961 | Guthrie et al. | 244/14 |
| 3,011,738 | 12/1961 | Skramstad et al. | 244/14 |
| 3,067,681 | 12/1962 | Beman | 102/49 |
| 3,072,365 | 1/1963 | Linscott et al. | 244/14 J |
| 3,081,049 | 3/1963 | Fuchs | 244/14 J |
| 3,098,445 | 7/1963 | Jackson | 102/49 |
| 3,098,446 | 7/1963 | Jasse | 102/50 |
| 3,127,838 | 4/1964 | Moratti et al. | 102/50 |

OTHER PUBLICATIONS

Besserer; *Missile Engineering Handbook,* Van Nostrand Co.; 1958 p. 523.

Locke; *Guidance,* Van Nostrand Co.; 1955 pp. 286 & 287.

*Primary Examiner*—Charles T. Jordan

*Attorney, Agent, or Firm*—Charles D. Brown; Randall M. Heald; Wanda K. Denson-Low

[57] ABSTRACT

An air vehicle control system utilizing variable incidence aerodynamic control surfaces deployed from within the missile body and locked in place. Only two control surfaces (instead of the four usually required for a missile which maneuvers in three dimensions) are required. The number of control surfaces required is reduced by utilizing missile roll to achieve control in any direction. Flight control of the air vehicle is achieved by a single pair of aerodynamic control surfaces located forward of the missile center of gravity. In order to produce a turning moment in any direction, the missile is rolled at a predetermined number of revolutions per second. The control surfaces are operated during the proper portion of each missile revolution to achieve the desired directional control.

14 Claims, 1 Drawing Sheet

CONTROL SYSTEM

This invention relates to control systems, particularly to air vehicle control systems, and more particularly to a control system utilizing variable incidence aerodynamic control surfaces.

There have been various types of control systems developed for air vehicles, especially for missiles. U.S. Pat. No. 3,010,677 illustrates a control system similar to the present invention in that it utilizes only two control surfaces instead of the four usually necessary in a missile which, maneuvers in three dimensions. As in the above cited patent, the number of control surfaces required is reduced by utilizing the missile roll to achieve control in any direction. However, this invention differs substantially from the control systems disclosed in the above mentioned patent in that this system utilizes variable incidence control surfaces which remain extended after launch while the patented system utilized variable area canards with fixed incidence, the area being variable by extending and retracting the canards with respect to the missile. Thus the simplicity of the instant system increases a missile's reliability considerably over the prior art control systems.

The preferred embodiment of this control system utilizes an optical infrared-homing head which, senses the direction of flight path error in polar coordinates and signals the control system to vary the incidence of the control surfaces to correct the flight path of the missile. The optics of the head could be of the Cassegrain type, for example.

Therefore, an object of this invention is to provide a control system for air vehicles.

Another object of the invention is to provide a more compact and comparatively small missile control system.

Another object of the invention is to provide a more simple and thus more reliable missile control system.

Another object of the invention is to provide a missile control system utilizing variable incidence control surfaces.

Other objects of the invention, not specifically set forth above, will become readily apparent from the following description and drawings wherein.

Figure 1:
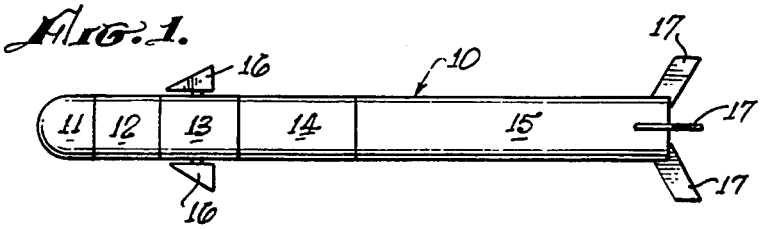
FIG. 1 is a schematic plan view of an air vehicle utilizing the invention.

Flight control of an air vehicle, such as a missile, is achieved by a single pair of aerodynamic control surfaces located forward of the missile center of gravity. In order to produce a turning moment in any direction, the missile is rolled at a nominal predetermined rate of revolutions per second. The homing head senses the direction of flight path error in polar coordinates referenced to the rolling missile axes, and operates the control surfaces during the proper portion of each missile revolution. The homing head supplies a sinusoidal error signal whose amplitude is proportional to the magnitude of the tracking error, and whose phase (relative to a spinning reference magnet) indicates the direction of the error in space quadrants. A set of reference coils mounted on the rolling airframe, and sensing a magnetic field from the seeker reference magnet, generates a signal which is proportional to the roll rate of the missile. The seeker and reference signals are compared in a phase sensitive demodulator which, after filtering, produces a sinusoidal signal of the same frequency and phase as the roll rate of the missile. The control surface actuator mechanism is adjusted to respond to the peak of this demodulator output wave, thus providing a control force at the proper time in the roll revolution to result in a turn in the direction of the tracking error.

The lift force generated by the control surfaces is only a fraction of the required total lift. The remainder is provided by the body and tail fins as a result of an angle of attack produced by the control surface operation. Since there is a time delay introduced by the phase demodulator filter and the control actuator, the reference coils must be rotated through an angle with respect to the plane of the control surfaces. The angle is such that the net lift force is in the direction of measured target tracking error at the nominal roll frequency.

This invention utilizes a pair of continuously extended canards whose incidence angle varies under control of a linear servo actuator. The actuator may be either electrical or hot gas driven. In fact, any actuator which can be used in a proportional servomechanism could be used in this system, so long as the required source of power can be made available. In this embodiment, a direct current electric actuator is utilized.

In a linear servo actuator system, the canard incidence continuously follows the error signal with the magnitude of the incidence proportional to the magnitude of the error signal. The advantageous features of the linear variable incidence canards are as follows:

1. There are two periods of effective maneuver per roll cycle of the missile.
2. The amplitudes of transients due to maneuvers are considerably less than the amplitude of transients for corresponding maneuvers with variable area canards.
3. Since the transients are less violent, larger trim angles of attack (and therefore greater maneuverability) are possible.
4. For the same area canards, this system yielded 50% more g's than the variable area canards, thus for the same maneuver capability, the canard area can be reduced.
5. Inertial coupling is considerably reduced.
6. Would be less sensitive to noise since deflections would be continuously proportional to the amplitude of the noise due to the wing coupling.
7. The problem of the canard surface induced rolling moment would be alleviated since the canard incidence in the range of the angular orientation of the angle of attack on the body with respect to the control plane would be nearly zero.
8. The phase compensation of the linear system is less sensitive than the prior art systems to changes in roll rate and flight conditions.

Figure 2:
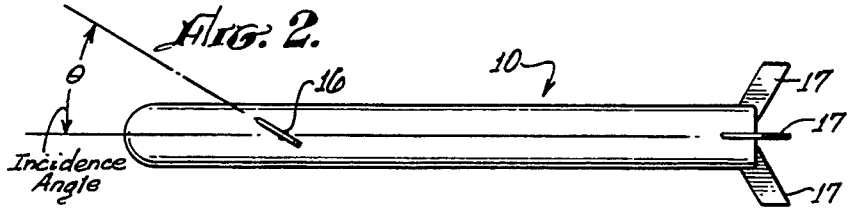
FIG. 2 is a side view of the FIG. 1 air vehicle showing the incidence angle of the control surfaces.

Referring now to the drawings, FIGS. 1 and 2 show an air vehicle such as a missile 10 which comprises a seeker head 11, packaged electronics section 12, control section 13, warhead 14, and motor section 15. The seeker head 11 is of the free gyro stabilized heat sensing type whose function is to provide a measurement of angular rate of the missile-to-target line of sight. Since the seeker head 11 does not constitute part of this invention, the details of its construction and function are deemed unnecessary and except for the operation thereof which is directly related to the control of the control section 13, will be omitted.

The packaged electronics section 12 contains the electronics for the seeker head 11 and does not constitute part of this invention; and the description thereof will be omitted except to state that it is the seeker guidance or demodulator output signal from electronics section 12 that is fed into the summing network as described hereinafter with respect to FIG. 5.

Flight control of the missile 10 is accomplished by a set of variable-angle or variable incidence control surfaces or wings 16 which are housed in section 13 during storage and launch and extended to flight position and locked in the extended position immediately after launch. The missile must roll continuously for wings or canards 16 to have effect on the control thereof. This roll may be established by various methods such as by the use of canted rocket nozzles or by canting the tail fins 17 of motor section 15 which are struck by the propulsion gases issuing therefrom. Tail fins 17 may be retracted during storage and launch to enable missile 10 to be fired from a tubular launcher and then extended by means such as by centrifugal force and locked in the extended or flight position.

Figure 3:
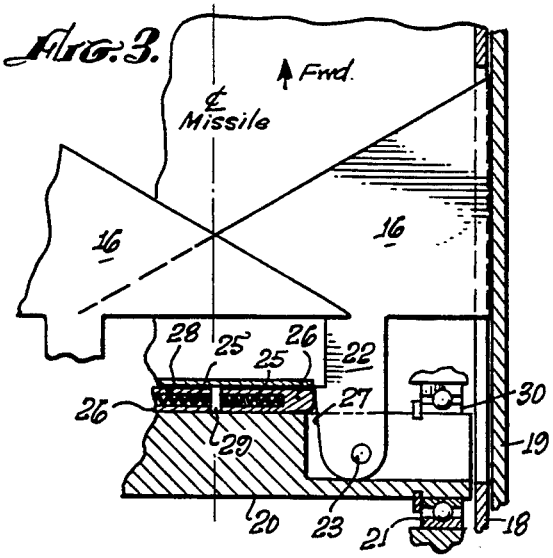
FIG. 3 is a view partially in cross section showing the control surfaces in folded position and a portion of the control mechanism.
Figure 4:
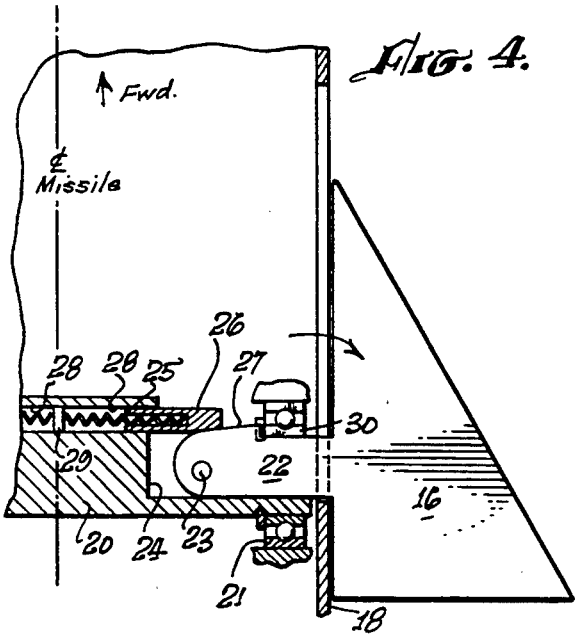
FIG. 4 is a view showing one of the control surfaces in extended or flight position.
Figure 5:
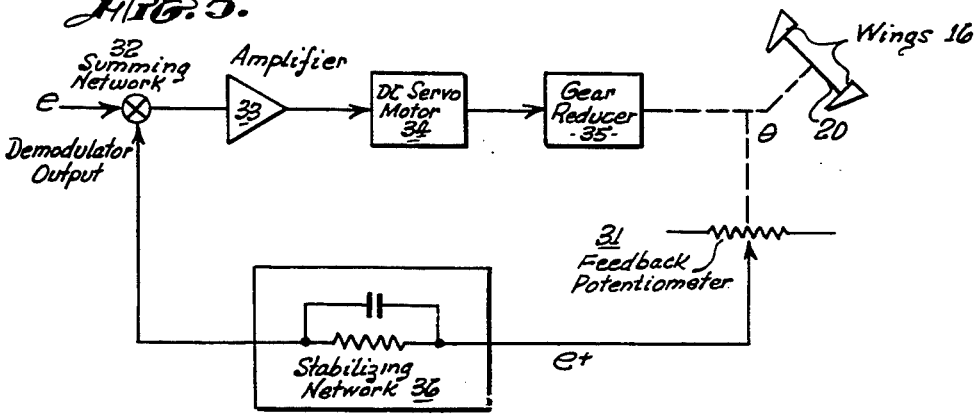
FIG. 5 is a block diagram of the servo-control system of the invention.

As shown in FIG. 2, wings or control surfaces 16 are varied through an incidence angle $\theta$ by the control mechanism illustrated and described with respect to FIGS. 3–5, the degree of the incidence angle of wings 16 determining the amount of directional change of missile 10 which is determined by the error or guidance signal from seeker head 11.

While the canards or wings 16 could have any reasonable shape, this embodiment uses the delta wing configuration because the wings must be rotated about a hinge line (pivot) which lies in the plane of the wings. This requires that the rotating actuator therefor overcome any aerodynamic restoring torque; such torque arises from the lift force generated on the wing panels and a moment arm between the application of the force (center of aerodynamic pressure) and the hinge line. The smaller this distance, the smaller the required torque to be applied by the actuator. It would be desirable to place the center of pressure exactly at the hinge line since this would result in negligible torques. This is not possible, since the center of pressure moves fore and aft as both Mach number and incidence angle change. The delta wing shape was selected as the best compromise, since the amount of travel of the center of pressure is the smallest for that wing planform.

Before the missile 10 is launched, the wings 16 are retracted into the missile body or shell 18 which is positioned in launch tube 19, as shown in FIG. 3. Both wings or canards 16 may be completely contained within the missile shell 18 because they are staggered with respect to the centerline of the wing support shaft 20, only one end of shaft 20 being shown, the other end thereof being substantially identical. Wing support shaft 20 is supported at each end by a bearing assembly 21 which is mounted in structure fixed to the missile body 18. Wings 16 are attached to or integral with wing or canard stubs 22 which are pivotably mounted at 23 in a cutaway section 24 of shaft 20. Wings 16 may be locked in the folded or retracted position shown in FIG. 3 by means such as a releasable catch (not shown) or they may be held in the folded position by simply allowing the trailing edges thereof to rest against the inside of the launch tube 19, as shown in FIG. 3. If the first mentioned method of locking the wings in the folded position is used, they may be unlocked at the time of missile launch by the use of a "dimple motor" and a time delay circuit (not shown). No unlocking device is necessary if the method shown in FIG. 3 is used.

When the missile 10 is launched, the wings 16 are extended to flight position shown in FIG. 4 by the force of a spring 25 which urges a holding mechanism such as lock shoe 26 against an inclined surface 27 integral with wing stubs 22. The centrifugal force acting on the wing panels and arising due to the missile roll about its longitudinal centerline aids in erecting the canards. A "dimple motor" and a time delay circuit could be used instead of the spring 25 if more force were required to extend or erect the wings 16 and seat the lock shoes 26. Spring 25 and lock shoes 26 are operatively positioned in a cylinder 28 which, may be integral with support shaft 20, as shown, or positioned in a separate cylinder which is coaxial with shaft 20. Cylinders 28 for each set of springs and lock shoes are separated by a separator or bottoming plate 29. The coupling mechanism between the wings 16 and the missile body is so constructed as to provide a damping action therein.

When the canards or wings 16 are erected or extended to flight attitude, as shown in FIG. 4, the lock shoes 26 which have been bearing against the stubs 22 during the erection procedure, seat against the inclined surfaces 27. The shoe 26 and the inclined surface 27 form a self locking taper and the wings 16 are effectively locked in the extended position.

To enable wings 16 to extend to the flight position wherein wing stubs 22 move within cutaway section 24 of shaft 20 from the FIG. 3 position to the FIG. 4 position, bearing assemblies 21 are provided with a longitudinal slot 30 which enables stubs 22 to pass therein. A slotted or sector bearing is adaptable to this application because the support shaft 20 only rotates through $\pm 15°$ (angle of incidence $\theta$ shown in FIG. 2) and because the lift and drag forces have a resultant force that can only have a direction that is away from the longitudinal slot 30 in the bearing assembly 21. The use of a sector ball bearing assembly in this embodiment is necessary because: (1) they do not inject large non-linear friction forces into the servo loop which can cause instability; (2) the shaft bearings must be as close to the lift and drag loads on the wing panels as possible to keep the bending moments on the support shaft 20 to a minimum which results in a smaller shaft and thus a lighter weight control system; and (3) the bearing must be placed as far outboard as possible to keep the center of the support shaft usable for the drive gear and feed back potentiometer (see FIG. 5).

The servomechanism used to control the wings 16 is of simple construction, as shown in the block diagram in FIG. 5. The demodulator or seeker guidance output voltage (e) is compared with wing 16 position which is measured as (e+) by a feedback potentiometer 31 in a summing network 32. The resultant error signal is amplified at 33 to a power level sufficient to drive a D.C. servo motor 34 which rotates the wings 16 through a gear train 35 which is operatively connected to support shaft 20. An RC stabilizing network 36 is included in the feedback loop to improve the dynamic response of the servo to the sinusoidal input voltage, as described above. In the absence of a tracking error signal (e=0), the feedback signal e+ causes the wings to return to center (angle $\theta=0$) so that no lift force is produced.

It has thus been shown that the linear variable incidence control system of this invention has the following advantages over the prior known control systems:

(1) For the same wing area and incidence angle, the linear variable incidence system inherently provides about 60% more average lift (turning moment) because by reversing incidence angle, this system can provide two control pulses per roll revolution, while the prior known fixed incidence systems can provide only one control pulse per roll revolution.

(2) For the same average force produced, the linear variable incidence system results in less dynamic overshoot (airframe oscillation and wobble) since the disturbing force is sinusoidal and not of a waveform of a rounded pulse which contains many harmonics of the pulse frequency of the prior known fixed incidence, variable area system.

(3) If operated at the same roll rate, the linear variable incidence system produces less dynamic coupling than the prior art fixed incidence, variable area system.

(4) The linear variable incidence system produces less undesired roll torques than the equivalent fixed incidence, variable area system.

While a particular embodiment of the invention has been illustrated and described, modifications thereof will be readily apparent to those skilled in the art, and it is intended to cover in the appended claims all such modifications as come within the spirit and scope of the invention.

What is claimed is:

1. A control system adapted to effect flight control of a rolling missile, said control system comprising a target seeker head mounted at the forward and of a missile shell and having means for generating electrical signals in accordance with the relative positions of the missile and an associated target, a plurality of fixed area lift producing variable incidence control surfaces adapted upon launch to extend from within said missile shell into the missile's airstream, means for extending said control surfaces from within said shell and locking same in the extended position, actuator means engaged with said control surfaces and operable to vary the incidence of said control surfaces twice during each revolution of the missile when energized by electrical control signals, electronic means connected to said seeker head and said actuator means to receive the electrical signals from said seeker head and transform them into said actuator electrical control signals, whereby the incidence angle of the control surfaces is selectively varied during that portion of the missile's roll necessary to keep the missile on a target intercept course.

2. A control system for a rolling missile, said control system comprising a target seeker head having means for generating electrical signals in accordance with the relative positions of the missile and an associated target, two fixed area variable incidence lift producing control wings extendable from within a missile shell into the missile's air stream, means for extending said control wings from within said missile shell and locking same in the extended position, an actuator engaged with said control wings and operable to vary the incidence of said wings during missile revolution when energized by electrical control signals, electronic means connected to said seeker head and said actuator to receive the electrical signals from the seeker head and transform them into wing actuator control signals, whereby the incidence of said wings is varied during that portion of the missile's roll necessary to keep the missile on a target intercept course.

3. A control system adapted to effect flight control of a rolling missile, said control system comprising a target seeker head having means for generating electrical signals in accordance with the relative positions of a missile and an associated target, two fixed area variable incidence lift producing control wings extendable from within a missile body into the missile's airstream, means for extending said control wings from within the missile body, means for locking said control wings in the extended position, an actuator engaged with said control wings and operable to vary the incidence of said wings when energized by electrical control signals, electronic means connected to said seeker head and said actuator to compare the electrical signals received from said seeker head and electrical signals from said actuator and transform them into said wing actuator control signals, whereby the incidence of the wings is varied during that portion of the missile's roll necessary to keep the missile on a target intercept course.

4. In a rolling missile flight control system having a target seeker head and electronic means for producing control signals in response to seeker head information, a plurality of variable incidence lift producing control surfaces extendable from within a missile body into the missile's airstream, means for extending said control surfaces from within the missile body and locking same in the extended position, a control signal responsive actuator engaged with said control surfaces and operable to vary the incidence of said surfaces in response to said control signals, whereby the incidence of said surfaces is varied during that portion of the missile's roll necessary to keep the missile on a target intercept course.

5. In a rolling missile flight control system having a target seeker head and electronic means for producing control signals in response to seeker head information, two variable incidence control wings extendable into the missile's airstream, means for extending said control wings from within a missile shell, means for locking said wings in the extended position, and a control signal responsive actuator engaged with said control wings and operable to vary the incidence of said wings when energized by said central signals.

6. In a rolling missile flight control system having a seeker head and electronic means for producing control signals in response to seeker head information, two variable incidence lift producing control wings extendable into a missile's airstream from within a body of said missile, means for extending said control wings from within the body of said missile, means for locking said control wings in the extended position, and an electronic control signal responsive actuator engaged with said control wings and operable to vary the incidence of said wings when energized by said electrical control signals.

7. In an air vehicle, a plurality of control surfaces, means for extending said control surfaces into the airstream of an air vehicle from within a body of the air vehicle after launch of the air vehicle, means for locking said control surfaces in the extended position, and means for moving said control surfaces about the longitudinal axes thereof to vary the incidence of said control surfaces in the extended position.

8. In an air vehicle, two variable incidence control surfaces extendable into the air stream of an air vehicle from within a body of the air vehicle, means for extending said control surfaces from within the body of the air vehicle, means for locking said control surfaces in the extended position, means for producing control signals in accordance with the relative positions of the air vehicle and a predetermined reference, and a control signal responsive actuator means engaged with said control surfaces and operable to vary the incidence of said control surfaces when energized.

9. A control system adapted to effect flight control of a rolling missile, said control system comprising an infrared sensitive target seeker head having means for generating electrical signals in accordance with the relative positions of the missile and an associated target, two fixed area variable incidence lift producing control wings extendable into the missile's airstream, means for extending said control wings from within a shell of said rolling missile, means for locking said control wings in the extended position, a control signal responsive actuator engaged with said control wings and operable to vary the incidence of said wings when energized by electrical control signals, and electronic means connected to said seeker head and said actuator to receive electrical signals from the seeker head and transform them into wing actuator control signals, whereby the incidence of said control wings is varied during that portion of the missile's roll necessary to keep the missile on a target intercept course.

10. The control system defined in claim 9, wherein said variable incidence control wings have a delta configuration.

11. The control system defined in claim 9, wherein said variable incidence control wings are pivotably mounted on a support shaft, said shaft being rotatably supported within said missile shell, said shaft including cutaway sections within which said control wings move when extended into the missile's airstream, said support shaft constituting a portion of said actuator.

12. The control system defined in claim 9, wherein said variable incidence control wings include a stub portion operatively connected with said actuator, and wherein said locking means includes resiliently mounted locking shoes operatively supported within said missile shell, said locking shoes extending against a portion of each of said wing stubs when said control wings are extended, thereby locking said wings into extended position.

13. The control system defined in claim 9, wherein said electronic means includes a feedback potentiometer operatively connected to said actuator, a summing network operatively connected to said feedback potentiometer and to said seeker head, and an amplifier operatively connected between said summing network and said actuator.

14. The control system defined in claim 13, wherein said electronic means additionally includes an RC stabilizing network operatively connected intermediate said feedback potentiometer and said summing network.

* * * * *